US011551650B2

(12) United States Patent
Jung

(10) Patent No.: US 11,551,650 B2
(45) Date of Patent: Jan. 10, 2023

(54) SUPPORT DEVICE FOR STRING INSTRUMENT AND STRING INSTRUMENT HAVING SAME

(71) Applicant: Jae Seok Jung, Wonju-si (KR)

(72) Inventor: Jae Seok Jung, Wonju-si (KR)

( * ) Notice: Subject to any disclaimer, the term of this patent is extended or adjusted under 35 U.S.C. 154(b) by 0 days.

(21) Appl. No.: 17/316,662

(22) Filed: May 10, 2021

(65) Prior Publication Data

US 2022/0157281 A1 May 19, 2022

(30) Foreign Application Priority Data

Nov. 13, 2020 (KR) ..... 10-2020-0152121

(51) Int. Cl.

| | |
|---|---|
| ***G10D 3/00*** | (2020.01) |
| ***G10G 5/00*** | (2006.01) |
| ***G10D 1/08*** | (2006.01) |

(52) U.S. Cl.
CPC ..... *G10G 5/005* (2013.01); *G10D 1/08* (2013.01); *G10D 3/00* (2013.01)

(58) Field of Classification Search
CPC ..... G10G 5/005; G10D 1/08; G10D 3/00
See application file for complete search history.

(56) References Cited

U.S. PATENT DOCUMENTS

| | | | |
|---|---|---|---|
| 1,945,162 | A | 1/1934 | Rasmussen |
| 9,514,721 | B1 | 12/2016 | Champion |
| 2008/0196572 | A1 | 8/2008 | Navarro |
| 2013/0092009 | A1 | 4/2013 | Barnett |

FOREIGN PATENT DOCUMENTS

| | | | | |
|---|---|---|---|---|
| DE | 20300431 | U1 | 3/2003 | |
| DE | 202009013224 | U1 | 2/2010 | |
| EP | 1895504 | A1 * | 3/2008 | ..... G10G 5/005 |
| EP | 1895504 | A1 | 3/2008 | |
| ES | 2674426 | A1 | 6/2018 | |
| KR | 101309117 | B1 | 9/2013 | |
| KR | 101418341 | B1 | 7/2014 | |
| KR | 101431553 | B1 | 8/2014 | |
| KR | 101465350 | B1 | 11/2014 | |
| KR | 20-2015-0003969 | U | 10/2015 | |

* cited by examiner

*Primary Examiner* — Kimberly R Lockett
(74) *Attorney, Agent, or Firm* — Invenstone Patent, LLC

(57) ABSTRACT

Disclosed are a support device for a string instrument and a string instrument having the same, the support device being easily stored without an unnecessary separate attachment/detachment process. The support device for a string instrument includes: fixing plates fixed to a body of a string instrument; a first rotary plate rotatably connected to the fixing plates; and a second rotary plate rotatably coupled to the first rotary plate, wherein the first rotary plate has a shape corresponding to one part of a side plate of the body, and the second rotary plate has a shape corresponding to another part of the side plate of the body which is different from one part of the side plate of the body.

10 Claims, 18 Drawing Sheets

SUPPORT DEVICE FOR STRING INSTRUMENT AND STRING INSTRUMENT HAVING SAME

CROSS-REFERENCE TO RELATED APPLICATIONS

This application claims the priority of Korean Patent Application No. 10-2020-0152121 filed on Nov. 13, 2020, in the Korean Intellectual Property Office, the disclosure of which is incorporated herein by reference.

BACKGROUND

Field

The present disclosure relates to a support device for a string instrument and a string instrument having the same.

Description of the Related Art

In general, a string instrument is a kind of musical instrument that produces sound using a plurality of strings. The sound is produced by twanging strings tensely fixed to a body of the string instrument or by drawing a bow across the strings.

A guitar, which is one of the string instruments, includes a body having a vacant space, a neck fixed to the body and extending by a predetermined length, a head connected to one end of the neck and having tuning pegs, and guitar strings tensely tightened by the tuning pegs and positioned to be spaced apart from one another at predetermined intervals on a front panel of the body.

In order to play the guitar, a player needs to play chords with one hand and twang the guitar strings with the other hand. In order for the player to smoothly play the guitar, the head needs to be positioned at a relatively higher position than the body.

Korean Utility Model Application Laid-Open No. 20-2015-0003969 discloses a guitar supporter configured to allow a player to take a comfortable posture suitable for playing the guitar.

The guitar supporter disclosed in the document includes a push plate coupled to a body of a guitar, a knee support plate supported on the player's thigh, and a cylindrical stand connecting a rod capable of adjusting a height.

However, the assistive guitar playing device disclosed in the document has a complicated structure, and the player is inconvenienced because the player needs to attach the guitar supporter to the guitar each time the player uses the guitar. Further, because the guitar supporter cannot be stored in a guitar casing, the player inconveniently needs to separately carry the guitar supporter.

SUMMARY

An object to be achieved by the present disclosure is to provide a support device for a string instrument and a string instrument having the same, the support device being easily stored without an unnecessary separate attachment/detachment process.

Technical problems of the present disclosure are not limited to the aforementioned technical problems, and other technical problems, which are not mentioned above, may be clearly understood by those skilled in the art from the following descriptions.

In one aspect, the present disclosure provides a support device for a string instrument, the support device including: fixing plates fixed to a body of a string instrument; a first rotary plate rotatably connected to the fixing plates; and a second rotary plate rotatably coupled to the first rotary plate, in which the first rotary plate has a shape corresponding to one part of a side plate of the body, and the second rotary plate has a shape corresponding to another part of the side plate of the body which is different from one part of the side plate of the body.

The fixing plates may include: a first fixing plate fixed to a part of the side plate and configured to be in contact with one surface of the first rotary plate; and a second fixing plate coupled to the first fixing plate and rotatably coupled to the first rotary plate, and the first fixing plate may prevent the first rotary plate from rotating in the other direction opposite to one direction.

The first rotary plate may include hinge parts provided at one end and the other end thereof, respectively, and the hinge parts may include: a first hinge part provided at one end of the first rotary plate and coupled to the second fixing plate; and a second hinge part provided at the other end of the first rotary plate, which is opposite to one end of the first rotary plate, and coupled to the second rotary plate.

In a state in which a part of the second rotary plate is in contact with the first rotary plate, the first rotary plate and the second rotary plate may be rotated from the second fixing plate and disposed at a first position.

In the state in which the first rotary plate and the second rotary plate are disposed at the first position, the second rotary plate may be rotated from the first rotary plate, such that the first rotary plate and the second rotary plate may be disposed at a second position.

In the state in which the first rotary plate and the second rotary plate are disposed at the second position, the second rotary plate may be rotated from the first rotary plate, such that the first rotary plate and the second rotary plate may be disposed at a third position.

In the state in which the first rotary plate and the second rotary plate are disposed at the third position, the first rotary plate and the second rotary plate may be rotated from the second fixing plate and disposed at a fourth position.

In which the state in which the first rotary plate and the second rotary plate are disposed at the third position may correspond to the state in which the first rotary plate and the second rotary plate are disposed at the first position.

The support device may further include a fixing part rotatably coupled to the first fixing plate of the fixing plates and having a shape corresponding to a shape of the first rotary plate.

The first rotary plate may further include a plurality of holes configured to support the fixing part and disposed in a direction perpendicular to the first hinge part.

The support device may further include rotary members including: a first rotary member coupled to the second fixing plate and the first rotary plate and configured to rotate the first rotary plate from the second fixing plate; and a second rotary member coupled to the first rotary plate and the second rotary plate and configured to rotate the second rotary plate from the first fixing plate.

According to the present disclosure, the support device for a string instrument may be accommodated in the string instrument casing in the state in which the support device is mounted on the string instrument. As a result, it is possible to reduce an unnecessary spatial loss.

The state in which the respective components are coupled to one another is maintained, it is possible to reduce the time required to assemble, attach, or detach the components.

The effects according to the present disclosure are not limited to the above-mentioned effects, and more various effects are included in the present disclosure.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
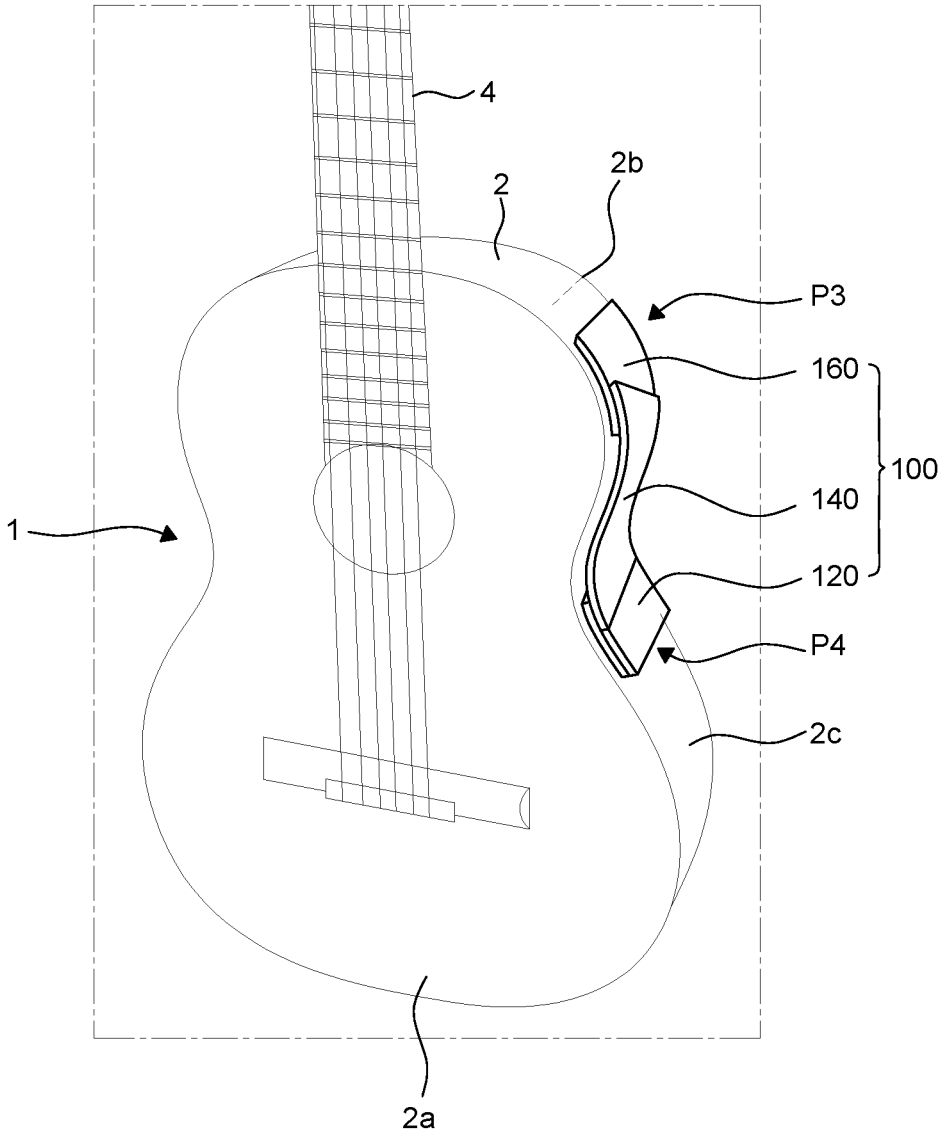
FIG. 1 is a view illustrating a state in which a support device for a string instrument according to an embodiment of the present disclosure is fixed to a string instrument and folded.

The embodiments disclosed in the present specification may be variously modified. Specific embodiments will be illustrated in the drawings and described in detail in the detailed description. However, the specific embodiments illustrated in the accompanying drawings are merely intended to facilitate understanding of various embodiments. Therefore, the technical spirit is not limited by the specific embodiments illustrated in the accompanying drawings, and the scope of the present disclosure should be understood as including all equivalents or substitutes included in the spirit and technical scope of the present disclosure.

The terms including ordinal numbers such as 'first,' 'second,' and the like may be used to describe various constituent elements, but the constituent elements are not limited by the terms. These terms are used only to distinguish one constituent element from another constituent element.

In the present specification, it should be understood the terms "comprises," "comprising," "includes," "including," "containing," "has," "having" or other variations thereof are inclusive and therefore specify the presence of stated features, integers, steps, operations, elements, components, or combinations thereof, but do not preclude the presence or addition of one or more other features, integers, steps, operations, elements, components, or combinations thereof. When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

Meanwhile, the term "module" or "unit" used for a constituent element used in the present specification performs at least one function or operation. Further, the "module" or "unit" may perform the function or operation by hardware, software, or a combination of hardware and software. In addition, except for the "module" or "unit" that should be performed in specific hardware or performed by at least one processor, a plurality of "modules" or a plurality of "units" may be integrated into at least one module. Singular expressions include plural expressions unless clearly described as different meanings in the context.

In addition, in the description of the present disclosure, the specific descriptions of related well-known functions or configurations will be summarized or omitted when it is determined that the specific descriptions may unnecessarily obscure the subject matter of the present disclosure.

Hereinafter, a support device for a string instrument will be described in more detail with reference to the accompanying drawings.

Figure 2:
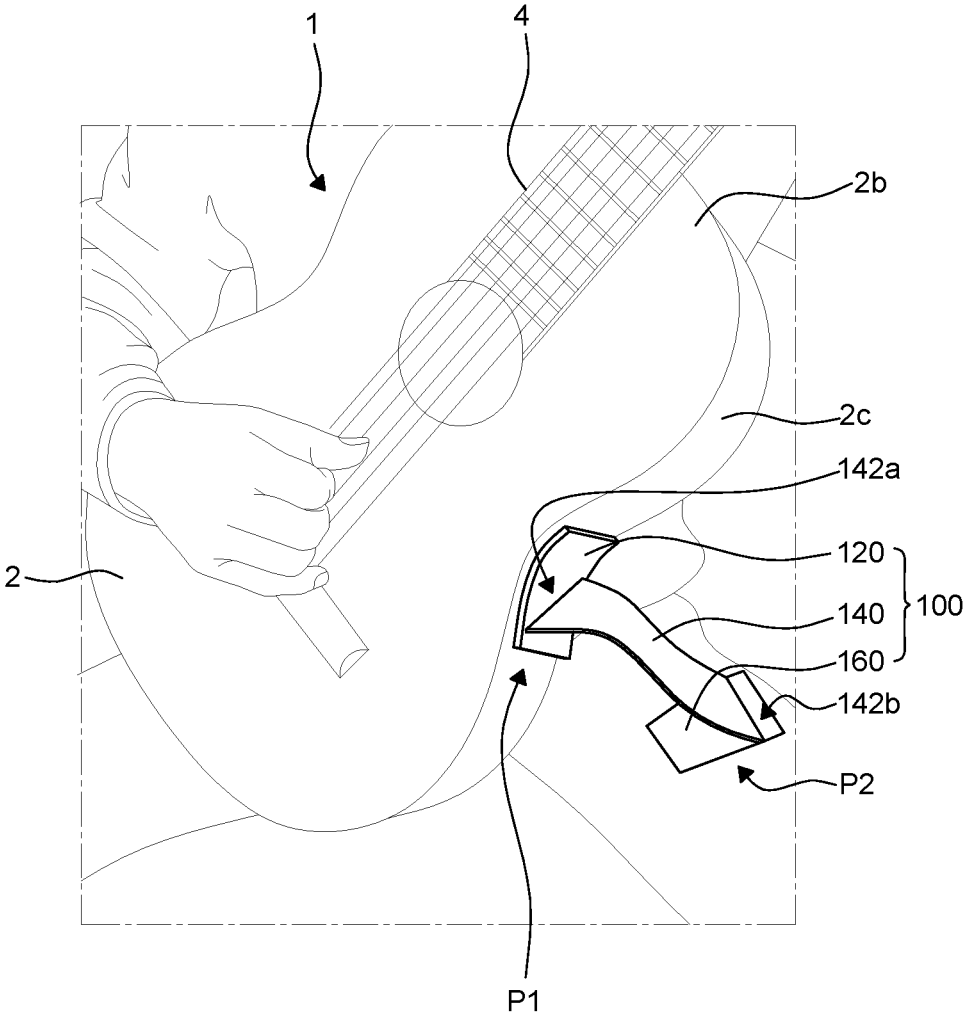
FIG. 2 is a view illustrating a state in which the support device for a string instrument according to the embodiment of the present disclosure is used.
Figure 3:
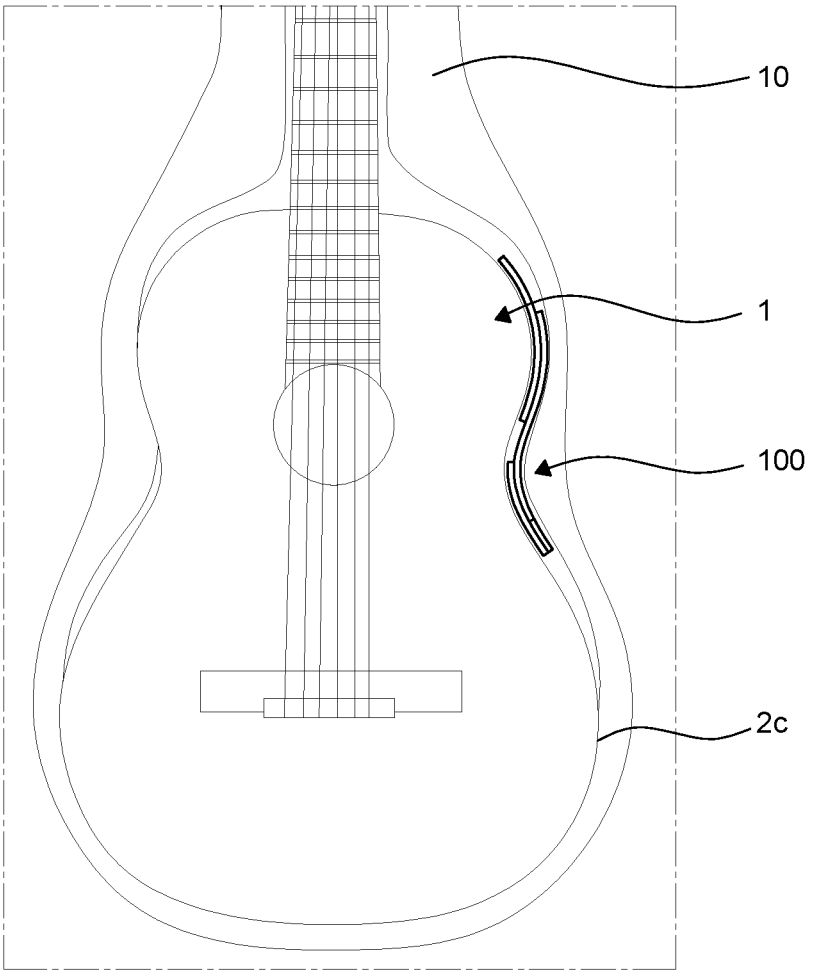
FIG. 3 is a view illustrating a state in which the support device for a string instrument according to the embodiment of the present disclosure is accommodated in a string instrument casing together with the string instrument.

FIG. 1 is a view illustrating a state in which a support device for a string instrument according to an embodiment of the present disclosure is fixed to a string instrument and folded, FIG. 2 is a view illustrating a state in which the support device for a string instrument according to the embodiment of the present disclosure is used, and FIG. 3 is a view illustrating a state in which the support device for a string instrument according to the embodiment of the present disclosure is accommodated in a string instrument casing together with the string instrument.

Referring to FIGS. 1 to 3, a string instrument 1 is configured to produce sound by twanging strings and may be accommodated in a string instrument casing 10.

The string instrument 1 includes a body 2 configured to allow the produced sound to resonate and transmit the sound, and a neck 4 fixed to the body 2 and extending by a predetermined length from the body 2. The body 2 includes an upper plate 2*a* having a sound hole, a lower plate 2*b* disposed to be spaced apart from the upper plate 2*a* and having a shape corresponding to a rim shape of the upper plate 2*a*, and a side plate 2*c* disposed between the upper plate 2*a* and the lower plate 2*b* and configured to be coupled to the upper plate 2*a* and the lower plate 2*b*.

The string instrument casing 10 is configured to accommodate the string instrument 1. The inside of the string instrument casing 10 has a shape corresponding to the shape of the string instrument 1 in order to prevent damage to the string instrument 1 which is caused when the string instrument 1 sways in the state in which the string instrument 1 is accommodated in the string instrument casing 10.

A support device 100 for a string instrument has a shape corresponding to a shape of an upper portion of the side plate 2*c* so as to be coupled to the upper portion of the side plate 2*c* of the body 2 of the string instrument 1. The support device 100 for a string instrument is configured to support the string instrument 1 and to be supported on a player's thigh.

Figure 4:
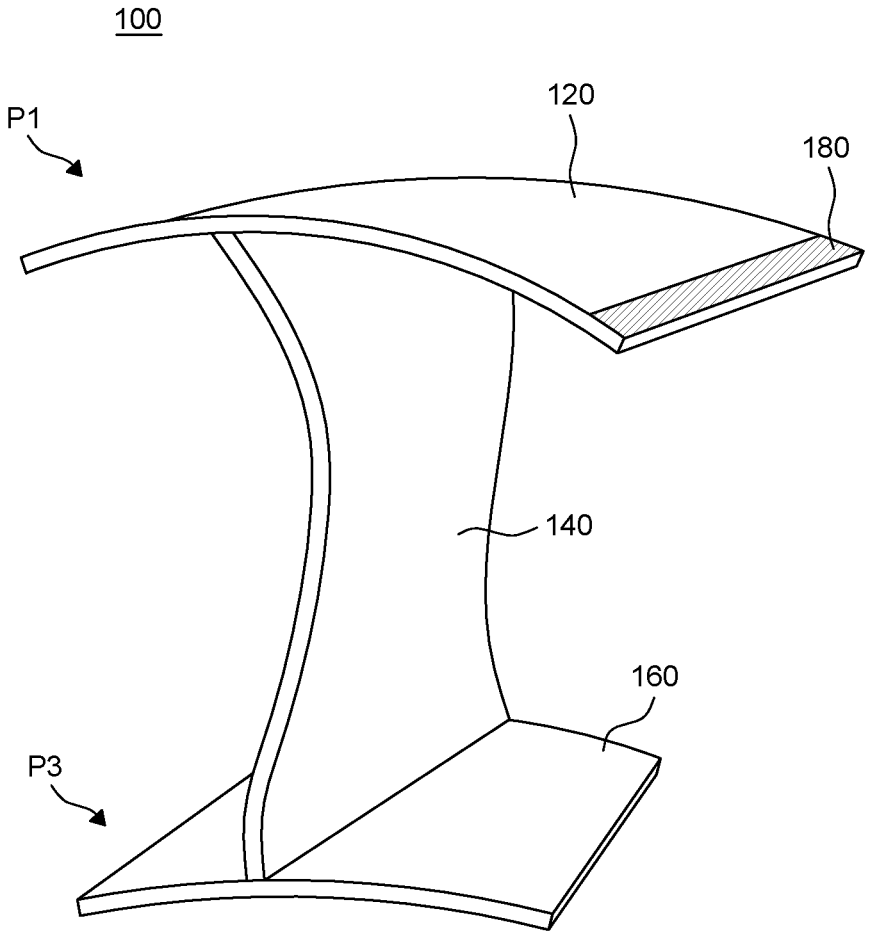
FIG. 4 is a perspective view illustrating a state in which the support device for a string instrument according to the embodiment of the present disclosure is unfolded.
Figure 5:
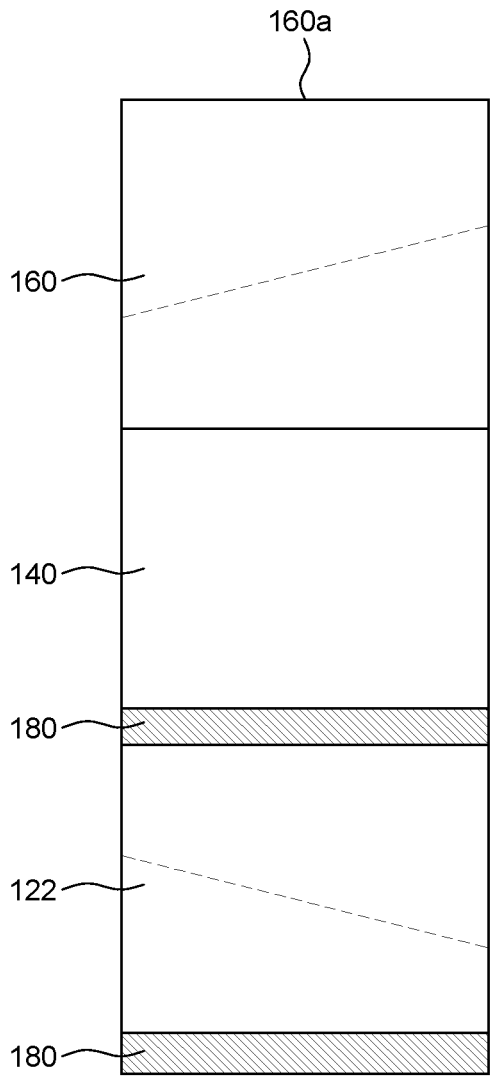
FIG. 5 is a front view illustrating a state in which the support device for a string instrument according to the embodiment of the present disclosure is folded.
Figure 6:
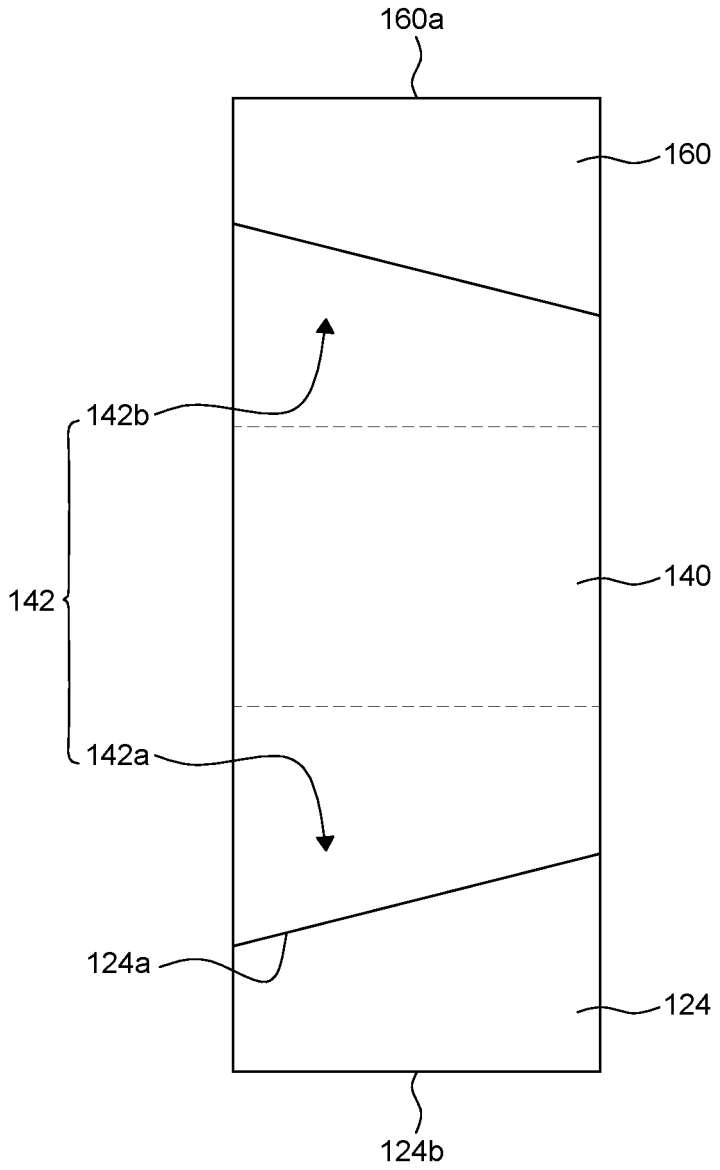
FIG. 6 is a rear view illustrating a state in which the support device for a string instrument according to the embodiment of the present disclosure is folded.
Figure 7:
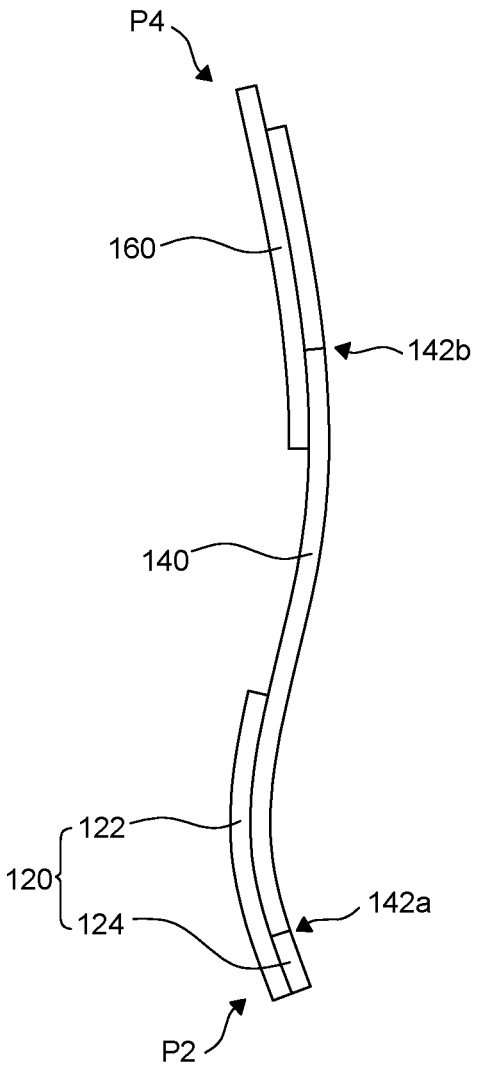
FIG. 7 is a side view illustrating a state in which the support device for a string instrument according to the embodiment of the present disclosure is folded.
Figure 8:
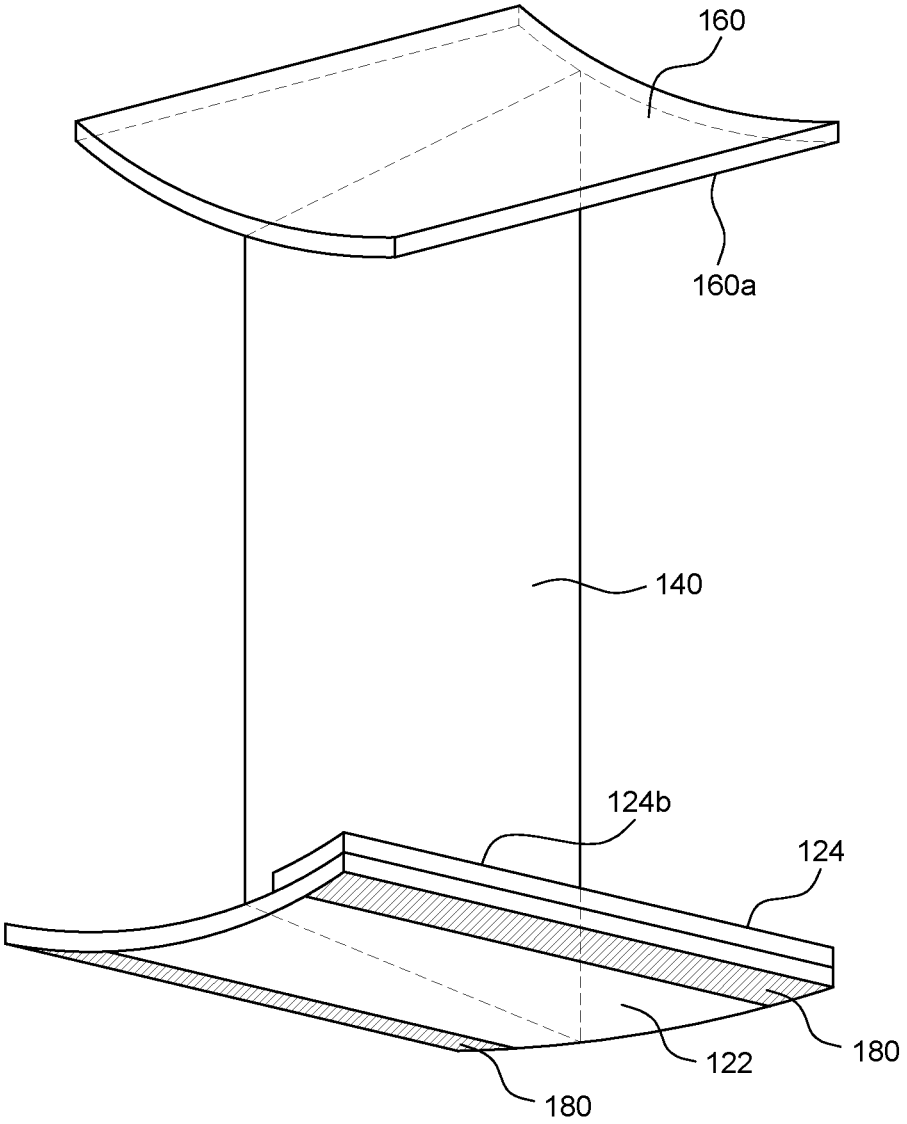
FIG. 8 is a front view illustrating a state in which the support device for a string instrument according to the embodiment of the present disclosure is unfolded.

FIG. 4 is a perspective view illustrating a state in which the support device for a string instrument according to the embodiment of the present disclosure is unfolded. FIG. 5 is a front view illustrating a state in which the support device for a string instrument according to the embodiment of the present disclosure is folded. FIG. 6 is a rear view illustrating a state in which the support device for a string instrument according to the embodiment of the present disclosure is folded. FIG. 7 is a side view illustrating a state in which the support device for a string instrument according to the embodiment of the present disclosure is folded. FIG. 8 is a front view illustrating a state in which the support device for a string instrument according to the embodiment of the present disclosure is unfolded.

Referring to FIGS. 4 to 8, the support device 100 for a string instrument includes fixing plates 120, a first rotary plate 140, and a second rotary plate 160.

The fixing plates 120 are fixed to the body 2 of the string instrument 1 and configured to rotate the string instrument 1 by means of the first rotary plate 140. A gradient of the fixing plates 120 with respect to the first rotary plate 140 may be adjusted.

The fixing plates 120 include a first fixing plate 122 and a second fixing plate 124.

The first fixing plate 122 is fixed to a part of the side plate 2*c* of the body 2 of the string instrument 1 and is in contact with one surface of the first rotary plate 140. A part of the first fixing plate 122 is in contact with one surface of the first rotary plate 140. The first fixing plate 122 enables the first rotary plate 140 to rotate only in one direction, and the first fixing plate 122 prevents the first rotary plate 140 from rotating in the other direction opposite to one direction. The first rotary plate 140 may rotate only in a direction away from the first fixing plate 122.

One surface of the second fixing plate 124 is coupled to a part of the first fixing plate 122, and one end 124*a* of the second fixing plate 124 is rotatably coupled to a first hinge part 142*a* of the first rotary plate 140.

One end 124*a* of the second fixing plate 124, which is rotatably coupled to the first hinge part 142*a* of the first rotary plate 140, is inclined with respect to the other end 124*b* of the second fixing plate 124. A shape of one end 124*a* of the second fixing plate 124 corresponds to a shape of one end of the first rotary plate 140.

The first rotary plate 140 is in contact with a part of the first fixing plate 122 of the fixing plates 120 and rotatably coupled to the second fixing plate 124. The first rotary plate 140 has a trapezoidal shape having a width that gradually decreases from one side toward the other side.

The first rotary plate 140 includes hinge parts 142. The hinge parts 142 include the first hinge part 142*a* and a second hinge part 142*b*.

The first hinge part 142*a* is provided at one end of the first rotary plate 140. The first hinge part 142*a* is coupled to one end 124*a* of the second fixing plate 124 of the fixing plates 120.

The second hinge part 142*b* is provided at the other end of the first rotary plate 140. The second hinge part 142*b* is coupled to the second rotary plate 160.

Since the first rotary plate 140 has a trapezoidal shape, one end of the first rotary plate 140, which defines the first hinge part 142*a*, is inclined with respect to the other end 124*b* of the second fixing plate 124, as illustrated in FIG. 6. The other end of the first rotary plate 140, which is opposite to one end of the first rotary plate 140 and defines the second hinge part 142*b*, is inclined with respect to one end 160*a* of the second rotary plate 160. The first hinge part 142*a* and the second hinge part 142*b* are not parallel to each other.

The first rotary plate 140 is rotated about the first hinge part 142*a*, and the second rotary plate 160 is rotated about the second hinge part 142*b*, such that the fixing plates 120 and the second rotary plate 160 are disposed to be distant from each other based on the first rotary plate 140.

The second rotary plate 160 has one surface being in contact with the side plate 2*c* and is rotatably coupled to the second hinge part 142*b* of the first rotary plate 140.

The second rotary plate 160 is connected to the other end of the first rotary plate 140 and rotated about the second hinge part 142*b* so as to be unfolded or folded.

The support device 100 for a string instrument may further include adhesive members 180 disposed on the fixing plates 120. The adhesive members 180 may be disposed at one side and the other side of the first fixing plate 122 of the fixing plates 120. The adhesive member 180 may be configured as a double-sided tape. First fixing plate 122 may be securely fixed to the body 2 of the string instrument 1 by the adhesive members 180.

In addition, although not illustrated, the adhesive member 180 may also be configured as a magnet. The adhesive members 180 may include a first member disposed on the side plate 2*c* of the body 2 of the string instrument 1, and a second member disposed on the first fixing plate 122 of the fixing plates 120. The first member may be provided in plural, and the second member may be provided in plural.

When the second member is fixed to the first member, the first fixing plate 122 may be fixed to the side plate 2*c* with a strong fixing force. In addition, the second member may be detachably coupled to the first member.

Hereinafter, states in which the first rotary plate and the second rotary plate are disposed at a first position, a second position, a third position, and a fourth position will be described.

In the state in which a part of the second rotary plate 160 is in contact with the first rotary plate 140, the first rotary plate 140 and the second rotary plate 160 are rotated clockwise from the second fixing plate 124 and disposed at a first position P1.

When the first rotary plate 140 and the second rotary plate 160 are disposed at the first position P1, the first rotary plate 140 may be unfolded from the first fixing plate 122, and the second rotary plate 160 may be kept in contact with the first rotary plate 140.

When the second rotary plate 160 is rotated from the first rotary plate 140 in the state in which the first rotary plate 140 and the second rotary plate 160 are disposed at the first position P1, the first rotary plate 140 and the second rotary plate 160 may be disposed at a second position P2.

When the first rotary plate 140 and the second rotary plate 160 are disposed at the second position P2, the second rotary plate 160 may be kept unfolded from the first rotary plate 140.

When the first rotary plate 140 and the second rotary plate 160 are disposed at the second position P2, the second rotary plate 160 may be in contact with and supported on the player's thigh. In the state in which the second rotary plate 160 is disposed at the second position P2, the player may adjust a gradient of the string instrument 1 by rotating the fixing plates 120 from the first rotary plate 140. In addition, the player may stably support the string instrument 1 with the second rotary plate 160 and take a comfortable posture suitable for playing the string instrument 1.

When the second rotary plate 160 disposed at the second position P2 is rotated counterclockwise, which is the direction opposite to clockwise, the first rotary plate 140 and the second rotary plate 160 may be disposed at a third position P3.

When the first rotary plate 140 and the second rotary plate 160 are disposed at the third position P3, the second rotary plate 160 may be in contact with a part of the first rotary plate 140. The arrangement state of the first rotary plate 140 and the second rotary plate 160 disposed at the third position P3 corresponds to the arrangement state of the first rotary plate 140 and the second rotary plate 160 disposed at the first position P1.

When the first rotary plate 140 and the second rotary plate 160 are rotated counterclockwise in the state in which the first rotary plate 140 and the second rotary plate 160 are disposed at the third position P3, the first rotary plate 140 and the second rotary plate 160 may be disposed at a fourth position P4.

When the first rotary plate 140 and the second rotary plate 160 are disposed at the fourth position P4, the second rotary plate 160 may be in contact with a part of the side plate 2*c*, and the second rotary plate 160 may be disposed between the first rotary plate 140 and the side plate 2*c*, as illustrated in FIG. 1. When the first rotary plate 140 and the second rotary plate 160 are disposed at the fourth position P4, the second rotary plate 160 may be prevented from being rotated away from the side plate 2*c* by gravity.

When the first rotary plate 140 and the second rotary plate 160 are disposed at the fourth position P4, the second rotary plate 160 is in contact with the side plate 2*c*, and as a result, the first rotary plate 140 connected to the second rotary plate 160 may also be prevented from being rotated away from the side plate 2*c* by gravity.

When the first rotary plate 140 and the second rotary plate 160 are disposed at the fourth position P4, the support device 100 for a string instrument may be accommodated in the string instrument casing 10 in the state in which the first rotary plate 140 and the second rotary plate 160 are folded, as illustrated in FIG. 3.

Figure 9A:
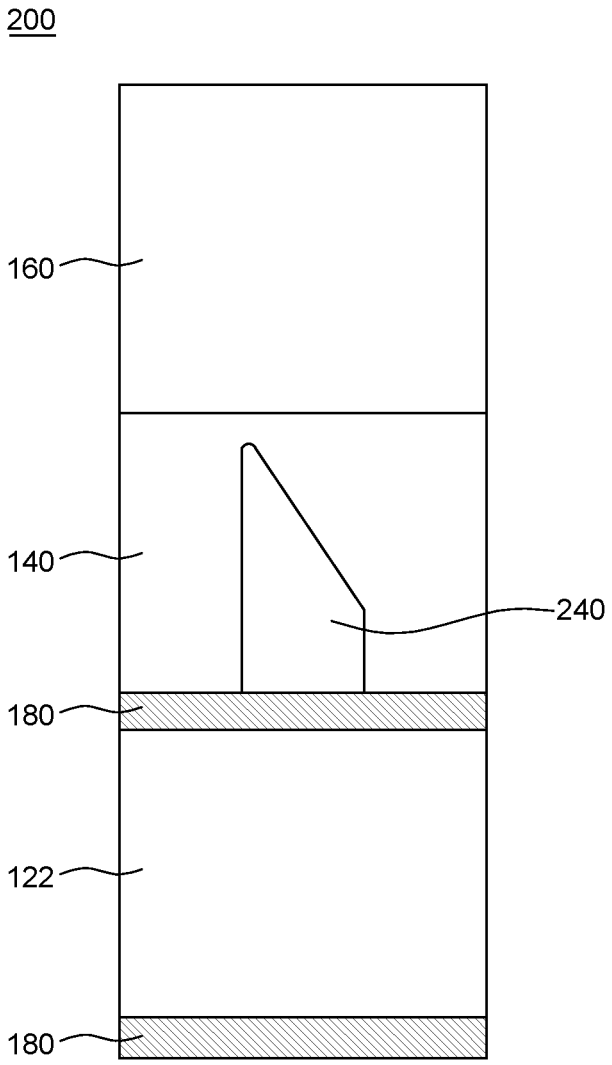
FIG. 9A is a front view illustrating a state in which a fixing part is disposed on a support device for a string instrument according to another embodiment of the present disclosure.
Figure 9B:
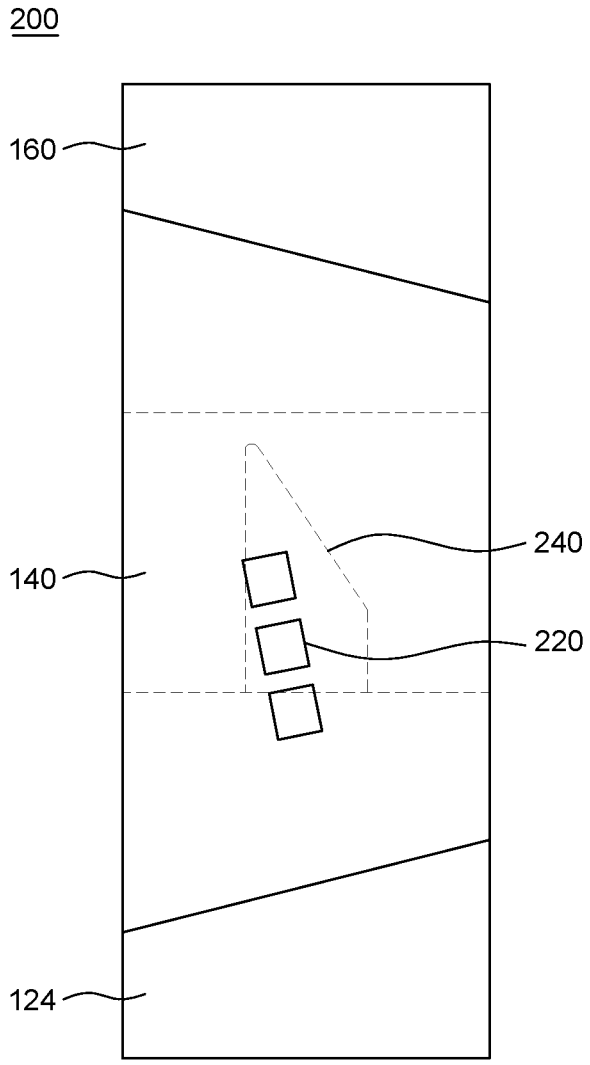
FIG. 9B is a rear view illustrating a state in which a plurality of holes is disposed on the support device for a string instrument according to another embodiment of the present disclosure.
Figure 10:
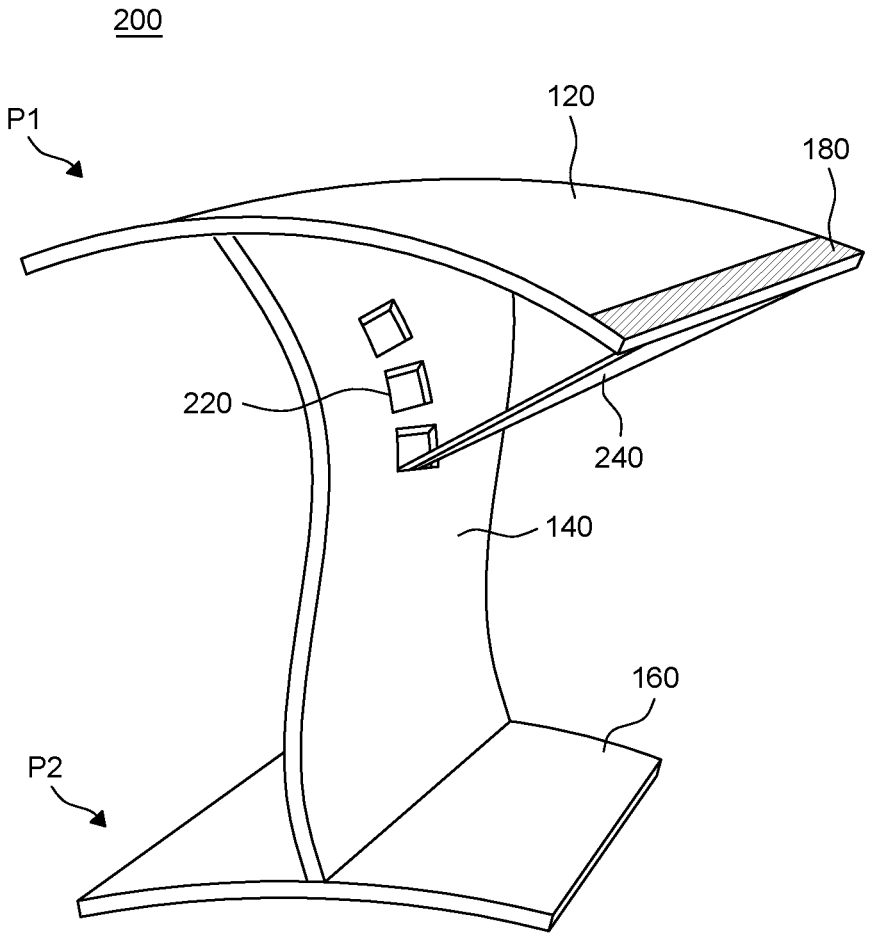
FIG. 10 is a view illustrating a state in which the fixing part is coupled to any one of the plurality of holes.

FIG. 9A is a front view illustrating a state in which a fixing part is disposed on a support device for a string instrument according to another embodiment of the present disclosure. FIG. 9B is a rear view illustrating a state in which a plurality of holes is disposed on the support device for a string instrument according to another embodiment of the present disclosure. FIG. 10 is a view illustrating a state in which the fixing part is coupled to any one of the plurality of holes;

Referring to FIGS. 9A, 9B, and 10, a support device 200 for a string instrument may include a plurality of holes 220 formed in the first rotary plate 140 and disposed to be spaced apart from one another, and a fixing part 240 coupled to the second fixing plate 124 of the fixing plates 120 and configured to be coupled to and supported by the plurality of holes 220.

The plurality of holes 220 may be disposed at one side of the first rotary plate 140 coupled to the fixing plates 120.

The plurality of holes 220 may be disposed in a direction perpendicular to the first hinge part 142*a*. One end of the first rotary plate 140, which defines the first hinge part 142*a*, is inclined with respect to the other end 124*b* of the second fixing plate 124. Since the plurality of holes 220 is disposed in the direction perpendicular to the first hinge part 142*a*, the plurality of holes 220 may be disposed to be inclined with respect to the other end 124*b* of the second fixing plate 124.

In the present embodiment, each of the plurality of holes 220 has a quadrangular shape, but the present disclosure is not limited thereto, and each of the plurality of holes 220 may have a triangular shape, a circular shape, an elliptical shape, and a polygonal shape.

In addition, the number of holes 220 may be three, but the present disclosure is not limited thereto, and the number of holes 220 may be three or less or more.

The fixing part 240 may be rotatably coupled to the first fixing plate 122 of the fixing plates 120.

The fixing part 240 may be coupled to and supported by any one of the plurality of holes 220 in the state in which the first rotary plate 140 is disposed at the first position P1 and the second rotary plate 160 is disposed at the second position P2. The gradient of the string instrument 1 may be adjusted in accordance with the position at which the fixing part 240 is coupled to any one of the plurality of holes 220. The player may take an optimal posture for playing the string instrument 1 by adjusting the gradient of the string instrument 1 with the fixing part 240.

Since the fixing part 240 may have a shape corresponding to the shape of the first rotary plate 140, the fixing part 240 may be in contact with the first rotary plate 140 while corresponding to the first rotary plate 140. The fixing part 240 may be accommodated in the string instrument casing 10 together with the string instrument 1 in the state in which the fixing part 240 is in contact with the first rotary plate 140.

In the present embodiment, the fixing part 240 has a wedge shape, but the present disclosure is not limited thereto, and the fixing part 240 may have a quadrangular shape, an elliptical shape, or a polygonal shape as long as the fixing part 240 may be coupled to and supported by any one of the plurality of holes 220.

Figure 11:
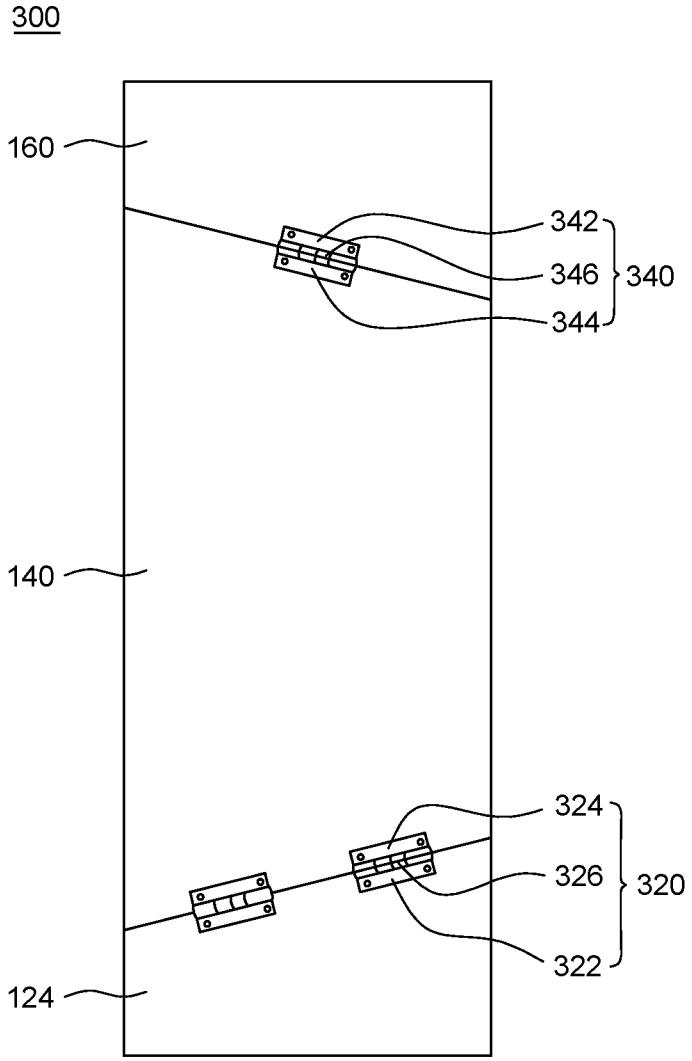
FIG. 11 is a view illustrating rotary members disposed on a support device for a string instrument according to still another embodiment of the present disclosure.
Figure 12:
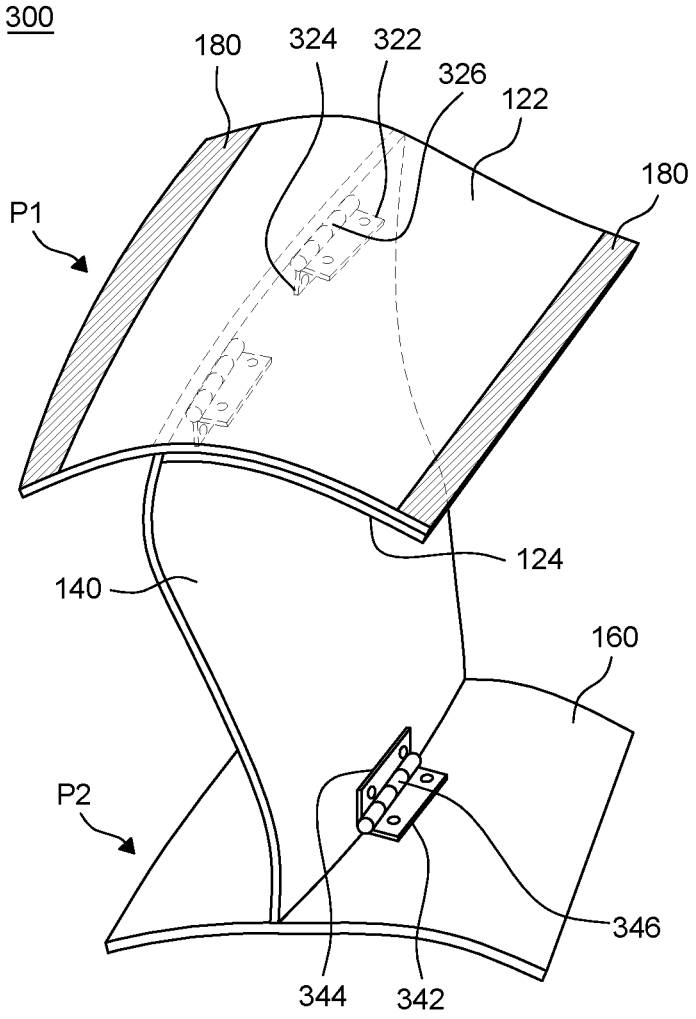
FIG. 12 is a view illustrating a state in which a first rotary plate and a second rotary plate are unfolded by the rotary members.

FIG. 11 is a view illustrating rotary members of a support device for a string instrument according to still another embodiment of the present disclosure, and FIG. 12 is a view illustrating a state in which the first rotary plate and the second rotary plate are unfolded by the rotary members.

Referring to FIGS. 11 and 12, a support device 300 for a string instrument according to another embodiment of the present disclosure may include: first rotary members 320 coupled to the second fixing plate 124 and the first rotary plate 140 and configured to rotate the first rotary plate 140 from the fixing plates 120; and a second rotary member 340 coupled to the first rotary plate 140 and the second rotary plate 160 and configured to rotate the second rotary plate 160 from the first rotary plate 140.

The first rotary member 320 may include a first fixed body 322 fixed to the fixing plate 120, a first rotary body 324 fixed to the first rotary plate 140 and coupled to the first fixed body 322, and a first hinge shaft 326 provided to enable the first rotary body 324 to be rotated from the first fixed body 322.

The second rotary member 340 may include a second fixed body 342 fixed to the first rotary plate 140, a second rotary body 344 fixed to the second rotary plate 160 and coupled to the second fixed body 342, and a second hinge shaft 346 provided to enable the second rotary body 344 to be rotated from the second fixed body 342.

When the first rotary body 324 is rotated about the first hinge shaft 326 clockwise from the first fixed body 322, the first rotary plate 140 and the second rotary plate 160 may be disposed at the first position P1.

When the second rotary body 344 is rotated about the second hinge shaft 346 clockwise from the second fixed body 342 in the state in which the first rotary plate 140 and the second rotary plate 160 are disposed at the first position P1, the first rotary plate 140 and the second rotary plate 160 may be disposed at the second position P2.

When the first rotary plate 140 and the second rotary plate 160 are disposed at the second position P2, the second rotary plate 160 may be in contact with and supported on the player's thigh, and the state in which the fixing plates 120 support the string instrument 1 may be maintained.

The player may take a comfortable posture suitable for playing the string instrument 1 by means of the first rotary members 320 and the second rotary member 340.

When the second rotary body 344 is rotated about the second hinge shaft 346 counterclockwise from the second fixed body 342, the first rotary plate 140 and the second rotary plate 160 may be disposed at the third position P3.

When the first rotary body 324 is rotated about the first hinge shaft 326 counterclockwise from the first fixed body 322 in the state in which the first rotary plate 140 and the second rotary plate 160 are disposed at the third position P3, the first rotary plate 140 and the second rotary plate 160 may be disposed at the fourth position P4.

When the first rotary plate 140 and the second rotary plate 160 are disposed at the fourth position P4, the second rotary plate 160 may be in contact with the side plate 2*c*.

When the second rotary plate 160 is in contact with the side plate 2*c*, the support device 300 for a string instrument, together with the string instrument 1, may be accommodated in the string instrument casing 10 or mounted on a stand for the string instrument in the state in which the support device 300 for a string instrument is folded.

Hereinafter, another embodiment of the rotary member will be described with reference to the accompanying drawings.

Figure 13:
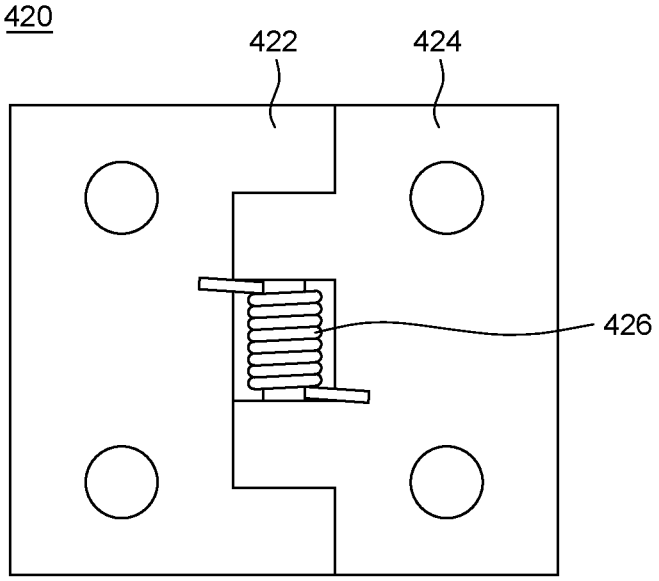
FIG. 13 is a view illustrating another embodiment of the rotary member.
Figure 14:
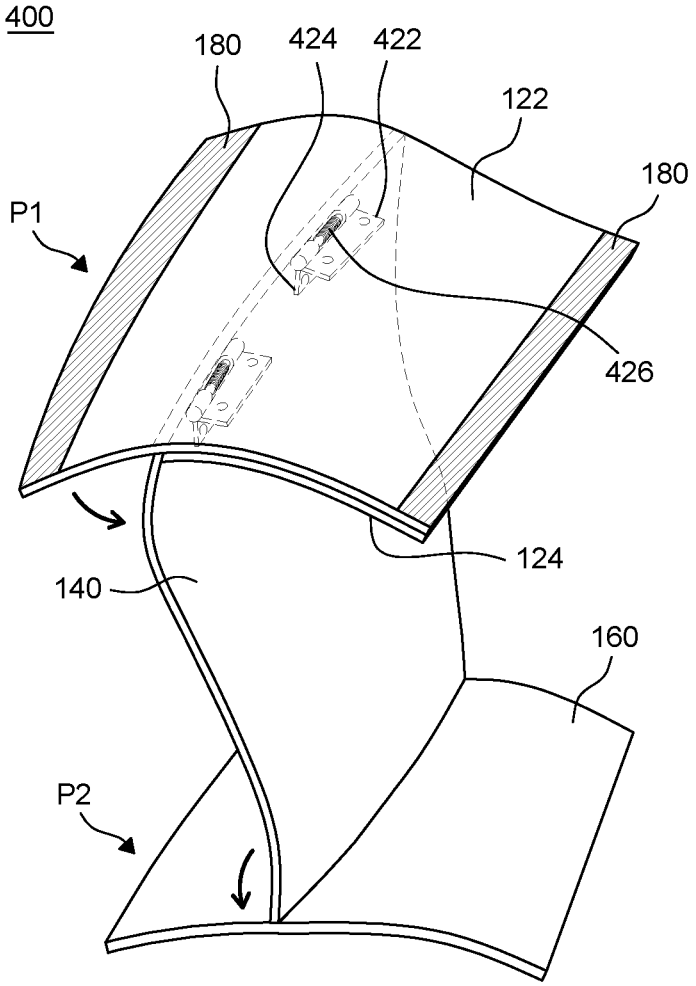
FIG. 14 is a view illustrating a state in which the rotary members are used.

FIG. 13 is a view illustrating another embodiment of the rotary member, and FIG. 14 is a view illustrating a state in which the rotary members are used.

Referring to FIGS. 13 and 14, a support device 400 for a string instrument according to yet another embodiment of the present disclosure may include rotary members 420 configured to enable the first rotary plate 140 to be rotated from the fixing plates 120.

The rotary member 420 may include a fixed body 422 fixed to the fixing plate 120, a rotary body 424 fixed to the first rotary plate 140 and coupled to the fixed body 422, and an elastic member 426 disposed between the rotary body 424 and the fixed body 422.

In an initial state of the rotary member 420, the rotary body 424 is unfolded without being rotated about the elastic member 426 from the fixed body 422, and the support device 100 for a string instrument may be maintained in the state in which the first rotary plate 140 is not rotated from the fixing plates 120.

In this state, when the rotary body 424 is rotated about the elastic member 426 clockwise from the fixed body 422, the first rotary plate 140 and the second rotary plate 160 are rotated from the second fixing plate 124 by torsion of the elastic member 426, such that the first rotary plate 140 and the second rotary plate 160 may be disposed at the first position P1.

When the second rotary plate 160 is rotated clockwise from the first rotary plate 140 in the state in which the first rotary plate 140 and the second rotary plate 160 are disposed at the first position P1, the first rotary plate 140 and the second rotary plate 160 may be disposed at the second position P2.

When the first rotary plate 140 and the second rotary plate 160 are disposed at the second position P2, the second rotary plate 160 may be in contact with and supported on the player's thigh, and the state in which the fixing plates 120 support the string instrument 1 may be maintained.

The player may take a comfortable posture suitable for playing the string instrument 1 by means of the rotary members 420.

In the state in which the first rotary plate 140 and the second rotary plate 160 are disposed at the second position P2, the player separates the second rotary plate 160 from his/her thigh and rotates the second rotary plate 160 counterclockwise from the first rotary plate 140, and as a result, the first rotary plate 140 and the second rotary plate 160 may be disposed at the third position P3.

Since the second rotary plate 160 is separated from the player's thigh in the state in which the first rotary plate 140 and the second rotary plate 160 are disposed at the third position P3, the twisted elastic member 426 may be elastically restored as the torsion is eliminated.

Since the rotary body 424 is rotated about the elastic member 426 which is elastically restored, the first rotary plate 140 coupled to the rotary body 424 and the second rotary plate 160 coupled to the first rotary plate 140 may be disposed at the fourth position P4.

Since the second rotary plate 160 may be in contact with a part of the side plate 2*c* in the state in which the first rotating body 140 and the second rotating body 160 are disposed at the fourth position P4, the support device 400 for a string instrument, together with the string instrument 1, may be accommodated in the string instrument casing 10 or mounted on the stand for the string instrument in the state in which the support device 400 for a string instrument is folded.

Figure 15:
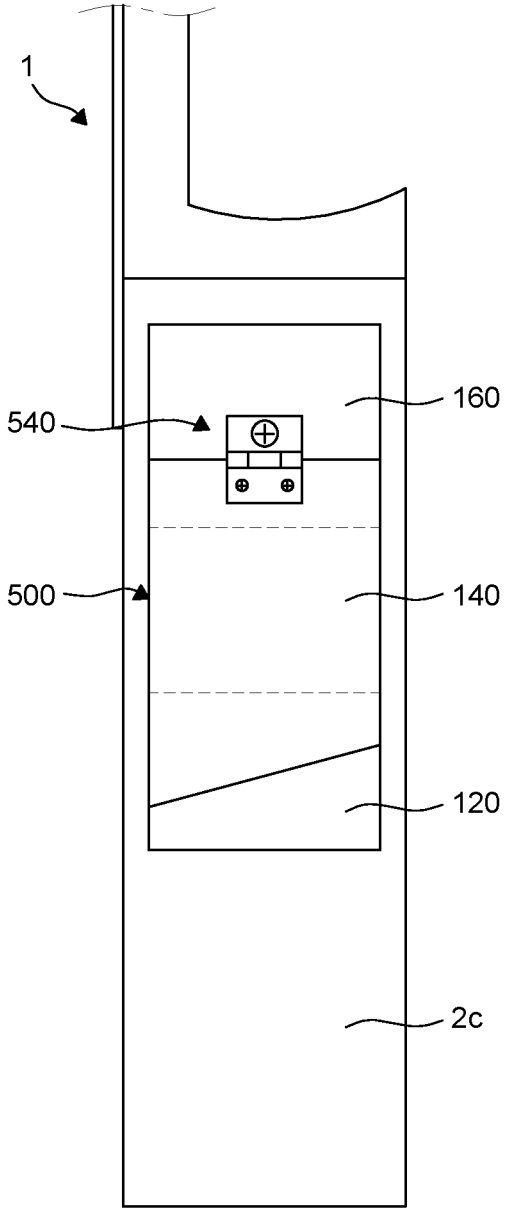
FIG. 15 is a view illustrating still another embodiment of the rotary member.
Figure 16:
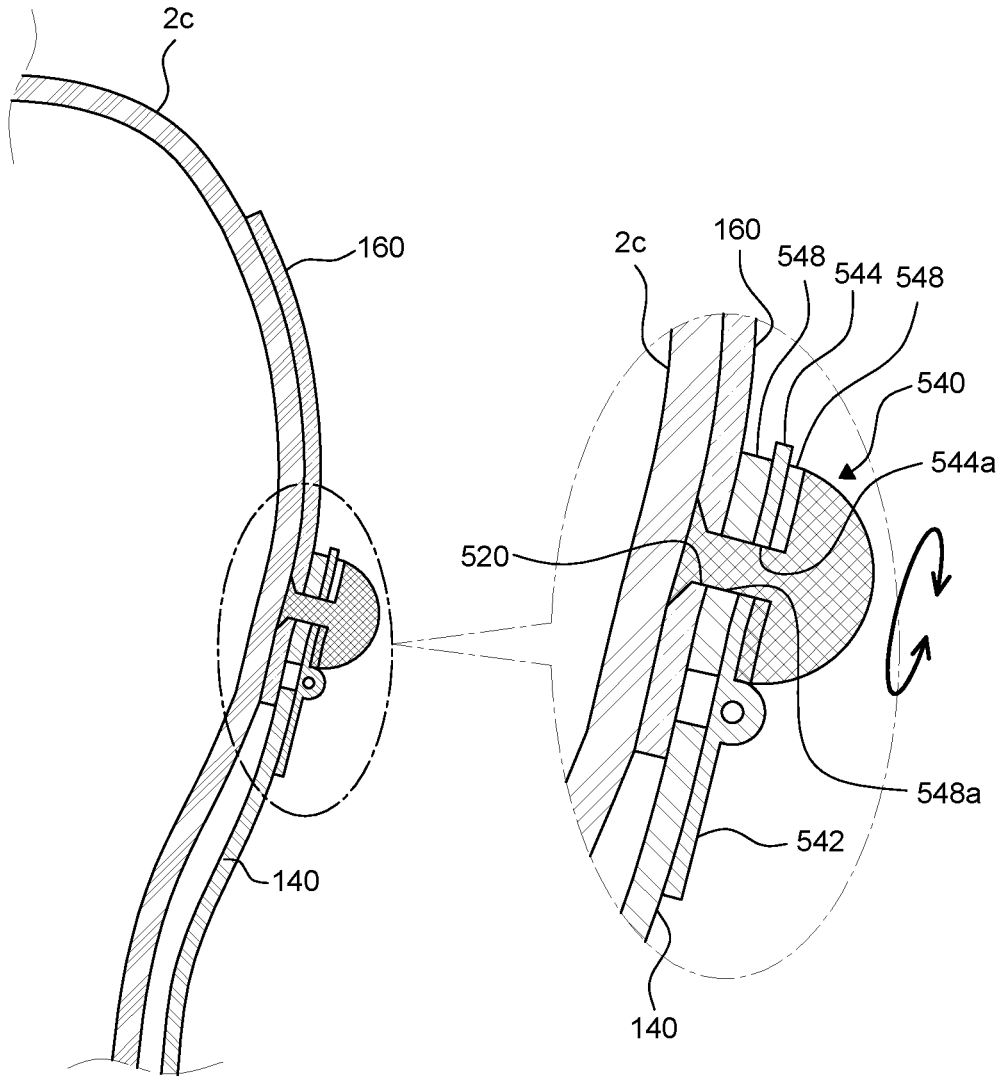
FIG. 16 is a cross-sectional view illustrating a state in which the rotary member is coupled to the support device for a string instrument.

FIG. 15 is a view illustrating still another embodiment of the rotary member, and FIG. 16 is a cross-sectional view illustrating a state in which the rotary member is coupled to the support device for a string instrument.

Referring to FIGS. 15 and 16, a support device 500 for a string instrument according to yet another embodiment of the present disclosure may further include a first coupling hole 520 formed in the second rotary plate 160, and a rotary member 540 configured to rotate the second rotary plate 160 from the first rotary plate 140.

The coupling hole 520 may be formed at one side of the second rotary plate 160. A rotary shaft 546 of the rotary member 540 may be accommodated in the coupling hole 520.

The rotary member 540 may be coupled to the first rotary plate 140 and the second rotary plate 160.

The rotary member 540 may include a fixed body 542, a rotary body 544, the rotary shaft 546, and blocks 548.

The fixed body 542 may be coupled to a part of the first rotary plate 140, and the fixed body 542 may be coupled to the rotary body 544.

The rotary body 544 is disposed to be spaced apart from the second rotary plate 160 with the block 548 interposed therebetween. The rotary body 544 may be coupled to the blocks 548 to rotate the second rotary plate 160.

The rotary body 544 may include a second coupling hole 544*a*. The rotary shaft 546 may be accommodated in the second coupling hole 544*a*.

The rotary shaft 546 may be accommodated in the first coupling hole 520, the second coupling hole 542*a*, and third coupling holes 548*a*. The second rotary plate 160 may be rotated about the rotary shaft 546. The second rotary plate 160 may be rotated clockwise or counterclockwise about the rotary shaft 546.

The blocks 548 are disposed between the second rotary plate 160 and the rotary body 544 and between the rotary body 544 and the rotary shaft 546, respectively. The blocks 548 may fix the rotary shaft 546 to the second rotary plate 160 and the rotary body 544 so that the rotary shaft 546 is not withdrawn from the second rotary plate 160 and the rotary body 544. The blocks 548 may include the third coupling holes 548*a*. The third coupling holes 548*a*, together with the first coupling hole 520 and the second coupling hole 544*a*, may accommodate the rotary shaft 546.

The player may finely adjust the gradient of the string instrument 1 by means of the rotary member 540. The player may take an optimal posture suitable for playing the string instrument by rotating the second rotary plate 160 by means of the rotary member 540.

Hereinafter, still yet another embodiment of the support device for a string instrument will be described with reference to the accompanying drawings.

Figure 17:
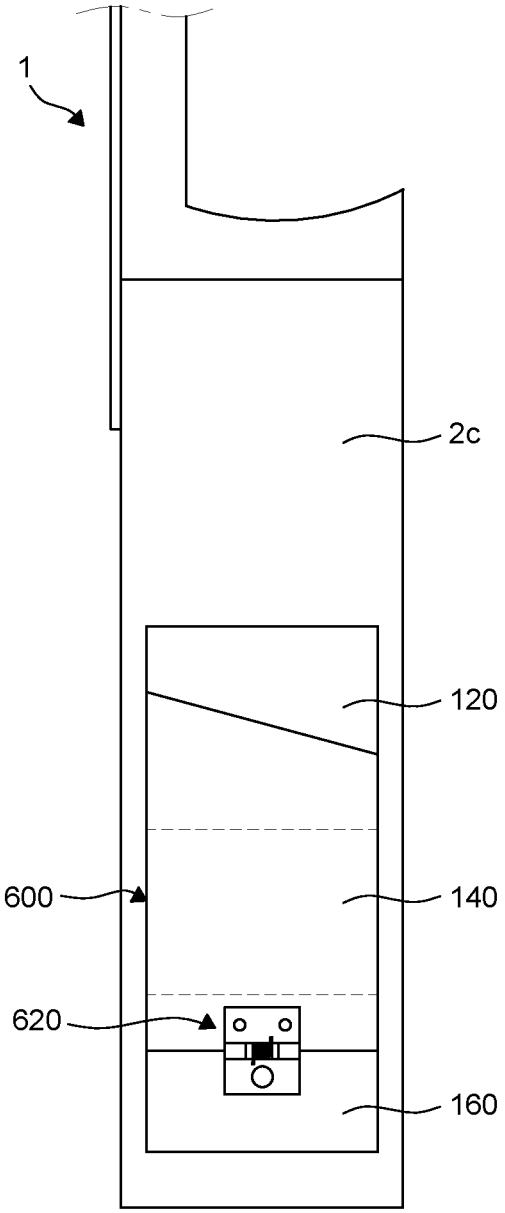
FIG. 17 is a view illustrating a state in which a support device for a string instrument according to still yet another embodiment of the present disclosure is fixed to the string instrument.

FIG. 17 is a view illustrating a state in which a support device for a string instrument according to still yet another embodiment of the present disclosure is fixed to the string instrument.

Referring to FIG. 17, a support device 600 for a string instrument, which is coupled to the side plate 2*c* of the string instrument 1, may be configured such that the first rotary plate 140 and the second rotary plate 160 are disposed to be directed toward a lower portion of the side plate 2*c* based on the fixing plates 120.

The support device 600 for a string instrument may include a rotary member 620 coupled to the first rotary plate 140 and the second rotary plate 160.

The rotary member 620 may include a fixed body fixed to the first rotary plate 140, a rotary body fixed to the second rotary plate 160 and coupled to the first rotary plate 140, and an elastic member disposed between the fixed body and the rotary body.

When the rotary member 620 is coupled to the support device 600 for a string instrument, the state in which the first rotary plate 140 and the second rotary plate 160 are disposed at the fourth position P4 may be maintained. The rotary member 620 may prevent the first rotary plate 140 and the second rotary plate 160 from swaying away from the side plate 2*c* during a process of moving the string instrument 1. In addition, the rotary member 620 may prevent the first rotary plate 140 and the second rotary plate 160 from swaying and being damaged due to a collision with the player or an object.

Although the embodiments of the present disclosure have been described in detail with reference to the accompanying drawings, the present disclosure is not limited thereto and may be embodied in many different forms without departing from the technical concept of the present disclosure. Therefore, the embodiments of the present disclosure are provided for illustrative purposes only but not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical spirit in the equivalent scope thereto should be construed as falling within the scope of the present disclosure.

What is claimed is:

1. A support device for a string instrument, the support device comprising:

fixing plates fixed to a body of a string instrument, the body including a side plate;

a first rotary plate that is rotatably connected to the fixing plates and has a shape corresponding to a first part of the side plate; and a second rotary plate rotatably coupled to the first rotary plate, the second rotary plate having a shape corresponding to a second part of the side plate which is different from the first part, wherein the fixing plates comprise:

a first fixing plate configured to be fixed to the side plate and to be in contact with a surface of the first rotary plate, and a second fixing plate coupled to the first fixing plate and rotatably coupled to the first rotary plate, the second fixing plate having a first end and a second end formed opposite to the first end of the second fixing plate, wherein the first rotary plate comprises:

a first hinge part provided at a first end of the first rotary plate and coupled to the second fixing plate, and a second hinge part provided at a second end of the first rotary plate and coupled to the second rotary plate, the second end of the first rotary plate formed opposite to the first end of the first rotary plate, wherein the first end of the second fixing plate is inclined with respect to the second end of the second fixing plate, wherein the first rotary plate has a trapezoidal shape, wherein the first hinge part is inclined with respect to the first end of the second fixing plate, and wherein the second hinge part is inclined with respect to one end of the second rotary plate such that the first hinge part and the second hinge part are not parallel to each other.

2. The support device of claim 1, wherein the first fixing plate prevents the first rotary plate from rotating in the other direction opposite to one direction.

3. The support device of claim 1, wherein in a state in which a part of the second rotary plate is in contact with the first rotary plate, the first rotary plate and the second rotary plate are rotated from the second fixing plate and disposed at a first position.

4. The support device of claim 3, wherein in the state in which the first rotary plate and the second rotary plate are disposed at the first position, the second rotary plate is rotated from the first rotary plate, such that the first rotary plate and the second rotary plate are disposed at a second position.

5. The support device of claim 4, wherein in the state in which the first rotary plate and the second rotary plate are disposed at the second position, the second rotary plate is rotated from the first rotary plate, such that the first rotary plate and the second rotary plate are disposed at a third position.

6. The support device of claim 5, wherein in the state in which the first rotary plate and the second rotary plate are disposed at the third position, the first rotary plate and the second rotary plate are rotated from the second fixing plate and disposed at a fourth position.

7. The support device of claim 5, wherein the state in which the first rotary plate and the second rotary plate are disposed at the third position corresponds to the state in which the first rotary plate and the second rotary plate are disposed at the first position.

8. The support device of claim 1, further comprising:

a fixing part having a shape corresponding to a shape of the first rotary plate and comprising:

a first end rotatably coupled to the first fixing plate of the fixing plates, and a second end formed opposite to the first end of the fixing part and configured to be supported by any one of a plurality of holes formed in the first rotary plate.

9. The support device of claim 8, wherein the plurality of holes are arranged in a direction perpendicular to the first hinge part.

10. The support device of claim 1, further comprising:

rotary members comprising:

a first rotary member coupled to the second fixing plate and the first rotary plate and configured to rotate the first rotary plate from the second fixing plate; and a second rotary member coupled to the first rotary plate and the second rotary plate and configured to rotate the second rotary plate from the first fixing plate.

* * * * *